US011094279B2

(12) United States Patent
Chu et al.

(10) Patent No.: US 11,094,279 B2
(45) Date of Patent: Aug. 17, 2021

(54) PIXEL COMPENSATION METHOD, PIXEL COMPENSATION DEVICE AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventors: Yifang Chu, Beijing (CN); Guangliang Shang, Beijing (CN); Jieqiong Wang, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/761,218

(22) PCT Filed: Nov. 27, 2018

(86) PCT No.: PCT/CN2018/117652
§ 371 (c)(1),
(2) Date: May 1, 2020

(87) PCT Pub. No.: WO2019/134465
PCT Pub. Date: Jul. 11, 2019

(65) Prior Publication Data

US 2020/0258468 A1 Aug. 13, 2020

(30) Foreign Application Priority Data

Jan. 2, 2018 (CN) ..... 201810002908.4

(51) Int. Cl.
*G09G 3/36* (2006.01)
*G09G 3/20* (2006.01)

(52) U.S. Cl.
CPC ..... *G09G 3/3688* (2013.01); *G09G 3/2003* (2013.01); *G09G 2300/0452* (2013.01); *G09G 2320/0276* (2013.01)

(58) Field of Classification Search
CPC ... G09G 2310/0248; G09G 2310/0251; G09G 3/2003; G09G 3/3688; G09G 2300/0452; G09G 2320/0276
See application file for complete search history.

(56) References Cited

U.S. PATENT DOCUMENTS 9,128,713 B2 9/2015 Knausz et al.
2014/0320521 A1 10/2014 Oh et al.
(Continued)

FOREIGN PATENT DOCUMENTS

CN 101388195 A 3/2009
CN 104299552 A 1/2015
(Continued)

OTHER PUBLICATIONS

ISA National Intellectual Property Administration of the People's Republic of China, International Search Report Issued in Application No. PCT/CN2018/117652, dated Feb. 27, 2019, WIPO, 20 pages. (Submitted with Partial Translation).
(Continued)

*Primary Examiner* — Kenneth Bukowski
(74) *Attorney, Agent, or Firm* — McCoy Russell LLP

(57) ABSTRACT

A pixel compensation method, a pixel compensation device and a display device are provided. The pixel compensation method includes: determining a target sub-pixel to be compensated in a display area; setting at least one charged sub-pixel connected to a same data line as the target sub-pixel, as a reference sub-pixel; acquiring a compensation
(Continued)

value of the target sub-pixel; and compensating a display parameter of the target sub-pixel based on the compensation value.

13 Claims, 4 Drawing Sheets

(56) References Cited

U.S. PATENT DOCUMENTS

| | | | | |
|---|---|---|---|---|
| 2014/0354625 | A1 | 12/2014 | Shin | |
| 2015/0022512 | A1 | 1/2015 | Ahn et al. | |
| 2015/0035866 | A1 | 2/2015 | Ann et al. | |
| 2016/0133176 | A1* | 5/2016 | Oh | G09G 3/3648 345/691 |
| 2016/0307529 | A1 | 10/2016 | Tseng et al. | |
| 2018/0182321 | A1* | 6/2018 | Zeng | G09G 3/3614 |
| 2018/0268753 | A1 | 9/2018 | Wang et al. | |
| 2020/0219460 | A1 | 7/2020 | Hu | |

FOREIGN PATENT DOCUMENTS

| | | | |
|---|---|---|---|
| CN | 104347045 | A | 2/2015 |
| CN | 106023939 | A | 10/2016 |
| CN | 106205514 | A | 12/2016 |
| CN | 106205536 | A | 12/2016 |
| CN | 106652966 | A | 5/2017 |
| CN | 107154242 | A | 9/2017 |
| CN | 107301852 | A | 10/2017 |
| CN | 108172183 | A | 6/2018 |

OTHER PUBLICATIONS

State Intellectual Property Office of the People's Republic of China, Office Action and Search Report Issued in Application No. 201810002908.4, dated Apr. 28, 2019, 20 pages. (Submitted with Partial Translation).

* cited by examiner

| | | | | | |
|---|---|---|---|---|---|
| $LUT_{(1,1)}$ | $LUT_{(1,2)}$ | $LUT_{(1,3)}$ | ..... | ..... | $LUT_{(1,n)}$ |
| $LUT_{(2,1)}$ | $LUT_{(2,2)}$ | $LUT_{(2,3)}$ | ..... | ..... | $LUT_{(2,n)}$ |
| ..... | ..... | ..... | ..... | ..... | ..... |
| $LUT_{(m,1)}$ | $LUT_{(m,2)}$ | $LUT_{(m,3)}$ | ..... | ..... | $LUT_{(m,n)}$ |

PIXEL COMPENSATION METHOD, PIXEL COMPENSATION DEVICE AND DISPLAY DEVICE

CROSS-REFERENCE TO RELATED APPLICATION

The present application is a U.S. national phase of International Application No. PCT/CN2018/117652 filed on Nov. 27, 2018 claims a priority to Chinese Patent Application No. 201810002908.4 filed in China on Jan. 2, 2018. The entire contents of each of the above-listed applications are hereby incorporated by reference for all purposes.

TECHNICAL FIELD

The present disclosure relates to the field of display technology, and in particular to a pixel compensation method, a pixel compensation device and a display device.

BACKGROUND

In order to maintain the stability of the screen display of the display device, a pre-charging circuit is designed between the timing module and the gate driving circuit, and the potential of the pre-charging signal is controlled by the timing module. When the pre-charging line is at a high potential, the gate driving circuit will turn on the gate lines of not less than one row in a scanning cycle, so that during the charging of the $n^{th}$ row of sub-pixels, the sub-pixels of the $(n+1)^{th}$, $(n+2)^{th}$ row are simultaneously pre-charged (the number of pre-charged sub-pixels is determined by the gate line turned on during the scan period).

For liquid crystal display devices, the polarity of the voltage difference applied to the liquid crystal molecules (that is, the polarity of the data signal) must be reversed at intervals to avoid permanent damage caused by the polarization of the liquid crystal material, and also to avoid the image residual effect.

The reversion of the data signal will make the pre-charging effect of the sub-pixels different. For example: under the same data signal drive, the sub-pixels with the same polarity as the data signal will complete pre-charging (i.e., forward pre-charging) faster, and the sub-pixels with different polarities from the data signal need to be reversed to the same polarity, and then can be pre-charged (that is, reverse pre-charge), and this reversal process requires a part of the time, resulting in the predicted pre-charge effect is not obtained under the limited charging time. It can be seen that even the sub-pixels driven by the same data signal line will have differences in charging, which results in an abnormal light spot (i.e., the Mura phenomenon) in the display effect, which seriously affects the user's viewing experience.

At present, there is no pixel compensation solution that can solve the problem that the sub-pixels have different light spots due to different pre-charging.

SUMMARY

A pixel compensation method is provided in the present disclosure, including:

determining a target sub-pixel to be compensated in a display area;

setting at least one charged sub-pixel connected to a same data line as the target sub-pixel, as a reference sub-pixel;

acquiring a compensation value of the target sub-pixel; and compensating a display parameter of the target sub-pixel based on the compensation value.

Optionally, the acquiring the compensation value of the target sub-pixel includes: acquiring a first compensation value according to the display parameter of the target sub-pixel and a display parameter of the reference sub-pixel;

the compensating the display parameter of the target sub-pixel based on the compensation value includes: compensating the display parameter of the target sub-pixel based on the first compensation value.

Optionally, the reference sub-pixel is a sub-pixel that is charged in a pre-charging stage of the target sub-pixel.

Optionally, the setting at least one charged sub-pixel connected to a same data line as the target sub-pixel, as the reference sub-pixel includes: setting two charged sub-pixels connected to the same data line as the target sub-pixel as the reference sub-pixels;

the acquiring the first compensation value according to the display parameter of the target sub-pixel and display parameter of the reference sub-pixel includes:

acquiring the first compensation value $P_{(i,j)}$ according to a formula $P_{(i,j)}=K_3[(K_1p_1+K_2p_2)-p]+p$;

where p represents a display parameter of the target sub-pixel before being compensated; $p_1$ represents a display parameter of one reference sub-pixel after being charged, $p_2$ represents a display parameter of another reference sub-pixel after being charged; $K_1$ is a first coefficient, $K_2$ is a second coefficient, $K_3$ is a third coefficient.

Optionally, sub-pixels in a row direction of the display area are arranged cyclically in an order of red sub-pixel, green sub-pixel and blue sub-pixel; a column of sub-pixels is arranged between two adjacent columns of data lines;

the sub-pixel of the column of sub-pixels which is in an odd-numbered row is configured to load a data signal of the data line on one side, and the sub-pixel of the column of sub-pixels which is in an even-numbered row is configured to load a data signal of the data line on the other side;

the acquiring the first compensation value further includes:

acquiring the first compensation value $P_{(i,j)}$ according to formula 1: $P_{(i,j)}=K_3[(K_1R'_{(i-2,j)}+K_2B'_{(i-1,j-1)})-R_{(i,j)}]+R_{(i,j)}$, in the case that target sub-pixel is a red target sub-pixel;

acquiring the first compensation value $P_{(i,j)}$ according to formula 2: $P_{(i,j)}=K_3[(K_1G'_{(i-2,j)}+K_2B'_{(i-1,j)})-G_{(i,j)}]+G_{(i,j)}$, in the case that the target sub-pixel is a green target sub-pixel;

acquiring the first compensation value $P_{(i,j)}$ according to formula 2: $P_{(i,j)}=K_3[(K_1B'_{(i-2,j)}+K_2G'_{(i-1,j)})-B_{(i,j)}]+B_{(i,j)}$, in the case that the target sub-pixel is a blue target sub-pixel;

where i represents an $i^{th}$ row of pixels in the display area where the referenced sub-pixels are arranged in, and j represents a $j^{th}$ column of pixels in the display area where the referenced sub-pixels are arranged in; $R_{(i,j)}$ represents the display parameter of the red target sub-pixel before being compensated; $R'_{(i-2,j)}$ represents the display parameter of the red reference sub-pixel after being charged; $B'_{(i-1,j-1)}$ represents the display parameter of the blue reference sub-pixel after being charged; $G_{(i,j)}$ represents the display parameter of the green target sub-pixel before being compensated; $G'_{(i-2,j)}$ represents the display parameter of the green reference sub-pixel after being charged; $B'_{(i-1,j)}$ represents the display parameter of the blue reference sub-pixel after being charged; $B_{(i,j)}$ represents the display parameter of the blue target sub-pixel before being compensated; $B'_{(i-2,j)}$ represents the display parameter of the blue reference sub-pixel after being charged; $G'_{(i-1,j)}$ represents the display parameter of the green reference sub-pixel after being charged.

Optionally, prior to the setting at least one charged sub-pixel connected to the same data line as the target sub-pixel as the reference sub-pixel, the method further includes:

acquiring a second compensation value of the target sub-pixel from a display lookup table;

where the display lookup table stores second compensation values of all sub-pixels in the display area; a magnitude of the second compensation value of each sub-pixel has a corresponding relationship with a position of the sub-pixel relative to a source driver and/or with a position of the sub-pixel relative to a gate driver.

Optionally, the compensating display parameter of the target sub-pixel based on the compensation value includes:

compensating the display parameter of the target sub-pixel based on the first compensation value and the second compensation value.

Optionally, the display parameter is a gray-scale value;

when compensating the gray-scale value of the target sub-pixel based on the compensation value, in the case that a theoretically compensated gray-scale value of the target sub-pixel exceeds a maximum gray-scale value supported by the target sub-pixel, the maximum gray-scale value is used as a gray-scale value of the target subpixel after being actually compensated.

The present disclosure also provides a pixel compensation device, including:

a first determining circuit, configured to determine a target sub-pixel to be compensated in a display area;

a second determining circuit, configured to set at least one charged sub-pixel connected to a same data line as the target sub-pixel as a reference sub-pixel;

a processing circuit, configured to acquire a compensation value of the target sub-pixel; and a compensation circuit, configured to compensating a display parameter of the target sub-pixel based on the compensation value.

Optionally, the processing circuit further includes a first processing sub-circuit, the first processing sub-circuit is configured to acquire a first compensation value according to the display parameter of the target sub-pixel and a display parameter of the reference sub-pixel;

the compensation circuit is further configured to compensate the display parameter of the target sub-pixel based on the first compensation value.

Optionally, the reference sub-pixel is a sub-pixel that is charged in a pre-charging stage of the target sub-pixel.

Optionally, the first processing sub-circuit is further configured to acquire the first compensation value according to the display parameter of the target sub-pixel and display parameter of the reference sub-pixel includes:

the first processing sub-circuit is further configured to acquire the first compensation value $P_{(i,j)}$ according to a formula $P_{(i,j)}=K_3[(K_1p_1+K_2p_2)-p]+p$;

where p represents a display parameter of the target sub-pixel before being compensated; $p_1$ represents a display parameter of one reference sub-pixel after being charged, $p_2$ represents a display parameter of another reference sub-pixel after being charged; $K_1$ is a first coefficient, $K_2$ is a second coefficient, $K_3$ is a third coefficient.

Optionally, sub-pixels in the row direction of the display area are arranged cyclically in an order of red sub-pixel, green sub-pixel, and blue sub-pixel; a column of sub-pixels is arranged between two adjacent columns of data lines;

the sub-pixel of the column of sub-pixels which is in an odd-numbered row is configured to load a data signal of the data line on one side, and a sub-pixel of the column of sub-pixels which is in an even-numbered row is configured to load a data signal of the data line on the other side;

the first processing sub-circuit is further configured to:

acquire the first compensation value$P_{(i,j)}$ according to formula 1: $P_{(i,j)}=K_3[(K_1R'_{(i-2,j)}+K_2B'_{(i-1,j-1)})-R_{(i,j)}]+R_{(i,j)}$, in the case that the target sub-pixel is a red target sub-pixel;

acquire the first compensation value $P_{(i,j)}$ according to formula 2: $P_{(i,j)}=K_3[(K_1G'_{(i-2,j)}+K_2B'_{(i-1,j)})-G_{(i,j)}]+G_{(i,j)}$, in the case that the target sub-pixel is a green target sub-pixel;

acquire the first compensation value$P_{(i,j)}$ according to formula 2: $P_{(i,j)}=K_3[(K_1B'_{(i-2,j)}+K_2G'_{(i-1,j)})-B_{(i,j)}]+B_{(i,j)}$, in the case that the target sub-pixel is a blue target sub-pixel;

where i represents an $i^{th}$ row of pixels in the display area where the referenced sub-pixels are arranged in, and j represents a $j^{th}$ column of pixels in the display area where the referenced sub-pixels are arranged in; $R_{(i,j)}$ represents the display parameter of the red target sub-pixel before being compensated; $R'_{(i-2,j)}$ represents the display parameter of the red reference sub-pixel after being charged; $B'_{(i-1,j-1)}$ represents the display parameter of the blue reference sub-pixel after being charged; $G_{(i,j)}$ represents the display parameter of the green target sub-pixel before being compensated; $G'_{(i-2,j)}$ represents the display parameter of the green reference sub-pixel after being charged; $B'_{(i-1,j)}$ represents the display parameter of the blue reference sub-pixel after being charged; $B_{(i,j)}$ represents the display parameter of the blue target sub-pixel before being compensated; $B'_{(i-2,j)}$ represents the display parameter of the blue reference sub-pixel after being charged; $G'_{(i-1,j)}$ represents the display parameter of the green reference sub-pixel after being charged.

Optionally, the processing circuit further includes a second processing sub-circuit, configured to acquire a second compensation value of the target sub-pixel from a display lookup table;

where the display lookup table stores second compensation values of all target sub-pixels in the display area; a magnitude of a second compensation value of each target sub-pixel has a corresponding relationship with a position of the target sub-pixel relative to the source driver and/or with a position of the target sub-pixel relative to the gate driver.

Optionally, the compensation circuit is further configured to compensate the display parameter of the target sub-pixel based on the first compensation value and the second compensation value.

A display device including the pixel compensation device as described above is further provided in the present disclosure.

A computer device is further provided in the present disclosure, including:

a processor, a memory and a computer program stored in the memory and executable on the processor, where the computer program is executed by the processor to:

determine a target sub-pixel to be compensated in a display area;

set at least one charged sub-pixel connected to a same data line as the target sub-pixel as a reference sub-pixel;

acquire a compensation value of the target sub-pixel; and compensate a display parameter of the target sub-pixel based on the compensation value.

A computer readable storage medium is further provided in the present disclosure, storing a computer program, where the computer program is executed by a processor to:

determine a target sub-pixel to be compensated in a display area;

set at least one charged sub-pixel connected to a same data line as the target sub-pixel as a reference sub-pixel;

acquire a compensation value of the target sub-pixel; and compensate a display parameter of the target sub-pixel based on the compensation value.

BRIEF DESCRIPTION OF THE DRAWINGS

To better clarify technical solutions of embodiments of the present disclosure, drawings used in description of the embodiments are briefly introduced hereinafter. Apparently, the described drawings merely illustrate a part of the disclosed embodiments. A person of ordinary skill in the art can obtain other drawings based on the described drawings without any creative work.

DETAILED DESCRIPTION

To make the technical problems, technical solutions, and advantages to be solved by the present disclosure clearer, the following will describe in detail with reference to the accompanying drawings and specific embodiments. In the following description, specific details such as specific configurations and components are provided merely to assist in a comprehensive understanding in some embodiments of the present disclosure. Therefore, it should be clear to those skilled in the art that various changes and modifications can be made to the embodiments described herein without departing from the scope and spirit of the present disclosure. In addition, descriptions of known functions and constructions are omitted for clarity and conciseness.

It should be understood that "one embodiment" or "the embodiment" mentioned throughout the specification means that a specific feature, structure, or characteristic related to the embodiment is included in at least one embodiment of the present disclosure. Therefore, "in one embodiment" or "in the embodiment" appearing throughout the specification does not necessarily refer to the same embodiment. In addition, these specific features, structures, or characteristics may be combined in one or more embodiments in any suitable manner.

The present disclosure is to solve the technical issue in the related art that the inconsistent pre-charge effects of factor pixels in a display device leads to a Mura phenomenon on a display screen.

Figure 1:
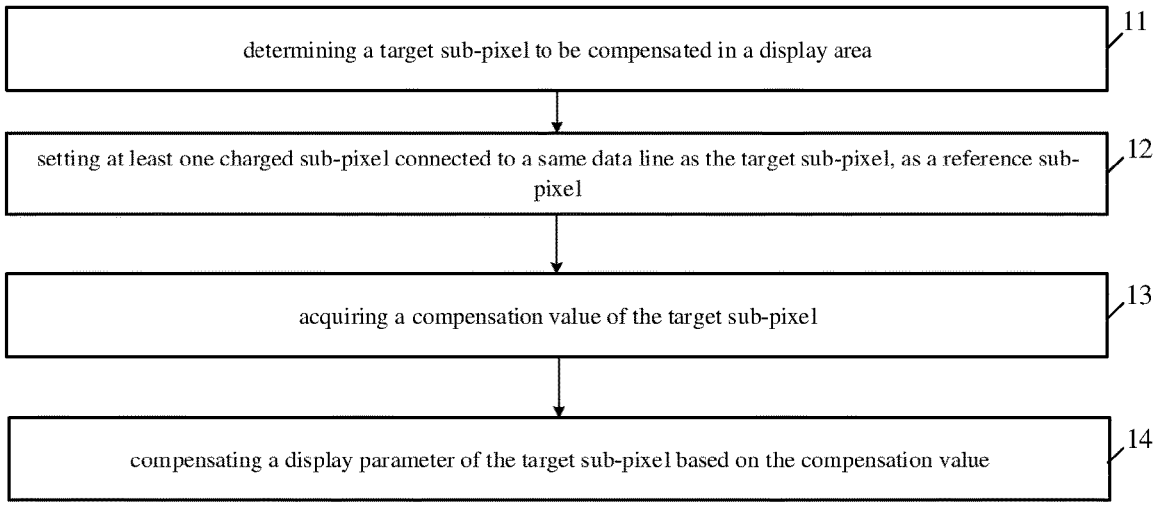
FIG. 1 is a schematic flowchart of a pixel compensation method in some embodiments of the present disclosure.

On one hand, a pixel compensation method is provided in some embodiments of the present disclosure, as shown in FIG. 1, including:

step 11, determining a target sub-pixel to be compensated in a display area;

step 12, setting at least one charged sub-pixel connected to a same data line as the target sub-pixel, as a reference sub-pixel;

step 13, acquiring a compensation value of the target sub-pixel, where the acquiring the compensation value of the target sub-pixel includes: acquiring a first compensation value according to a display parameter of the target sub-pixel and a display parameter of at least one reference sub-pixel;

step 14, compensating a display parameter of the target sub-pixel based on the compensation value (including the above first compensation value).

According to the pixel compensation method in some embodiments of the present disclosure, the display parameters of the target sub-pixel that currently needs to be compensated may be compared with the display parameters of the charged reference sub-pixel connected to the same data line with the target sub-pixel to determine the compensation value. Then, the target sub-pixel is compensated according to the compensation value to correct the display difference between the target sub-pixel and the reference sub-pixel due to different charging effects, thereby effectively reducing the Mura phenomenon in the display screen. For users, it can provide better display effect, so it has high practical value.

The pixel compensation methods in some embodiments of the present disclosure are described in detail below.

Specifically, in the above step 11, some embodiments of the present disclosure may acquire row field signal of the driving the display area, and then determine the target sub-pixel to be compensated in the display area according to the row field signal.

It should be noted here that the above row field signal is driving signal of the display area in the related art. In practical applications, some embodiments of the present disclosure may determine the currently predicted sub-pixels to be lighting according to the row field signal. The predicted lighting sub-pixel is the target sub-pixel in some embodiments of the present disclosure, that is, the target sub-pixel can complete the compensation of the display parameters before lighting, so as to ensure the display quality of the display screen.

After determining the target sub-pixel that is currently predicted to be lighting, the first compensation value of the target sub-pixel can be further calculated. As a feasible solution for calculating the first compensation value, some embodiments of the present disclosure specifically take the difference between the weighted sum value of the display parameters of all reference sub-pixels and the display parameter of the target sub-pixel, and quantify the difference to obtain the first compensation value.

For example, the above-mentioned reference sub-pixel may be, but not limited to, a sub-pixel that is charged in the pre-charging stage of the target sub-pixel. (Any sub-pixel connected to the target sub-pixel connected to the same data line with the target sub-pixel and charged before the target sub-pixel can be set as a reference sub-pixel)

Figure 2:
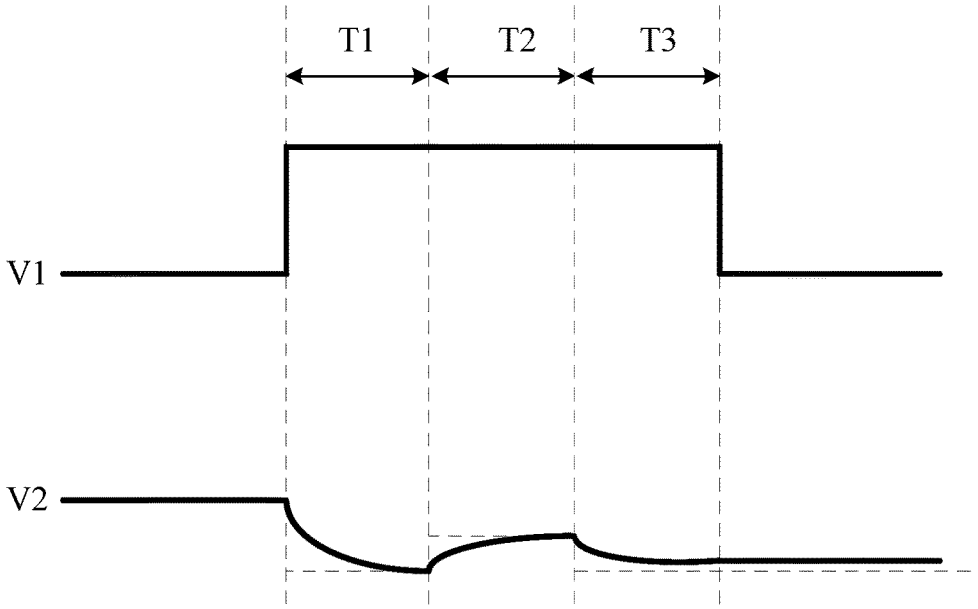
FIG. 2 is a schematic diagram of a charging time interval of sub-pixels when there are two pre-charging lines.

For example, assume that some embodiments of the present disclosure have two rows being precharged. Referring to FIG. 2, FIG. 2 is a charging time interval diagram of the $N^{th}$ sub-pixel connected to a certain data line, where the abscissa represents the time interval; the ordinate represents the voltage; V1 represents the scan signal, and V2 represents the data signal loaded by the sub-pixel (specifically, the data signal loaded by the pixel electrode of the sub-pixel can represent the charging potential of the sub-pixel).

In the T1 time interval, the $(N-2)^{th}$ subpixel connected to the data line is charged, and the $(N-1)^{th}$ and $N^{th}$ subpixels are in a pre-charging stage. In the T2 time interval, the $(N-1)^{th}$ sub-pixel is charged, and the $N^{th}$ sub-pixel is still in the pre-charging stage. In the T3 time interval, the $N^{th}$ sub-pixel starts to be charged.

In the T1 and T2 time intervals, when the data line charges the $(N-2)^{th}$ subpixel and the $(N-1)^{th}$ subpixel, the pre-charging effect of the $N^{th}$ subpixel (that is, the size of V2 in the pre-charging phase) will be affected. The charging effect of the $N^{th}$ sub-pixel in the T3 time interval will also be affected.

Therefore, in order to compensate for the $N^{th}$ subpixel, the $(N-2)^{th}$ subpixel and the $(N-1)^{th}$ subpixel should be set as reference subpixels relative to the $N^{th}$ subpixel (can also select one of them as the reference subpixel).

Therefore, for the above scenario, some embodiments of the present disclosure have two reference sub-pixels, it can to acquire the first compensation value $P_{(i,j)}$ according to the formula: $P_{(i,j)}=K_3[(K_1p_1+K_2p_2)-p]+p$;

where p represents a display parameter of the target sub-pixel before being compensated; $p_1$ represents a display parameter of one reference sub-pixel after being charged, $p_2$ represents a display parameter of another reference sub-pixel after being charged; $K_1$ is a first coefficient, $K_2$ is a second coefficient, $K_3$ is a third coefficient.

Figures 3, 4:
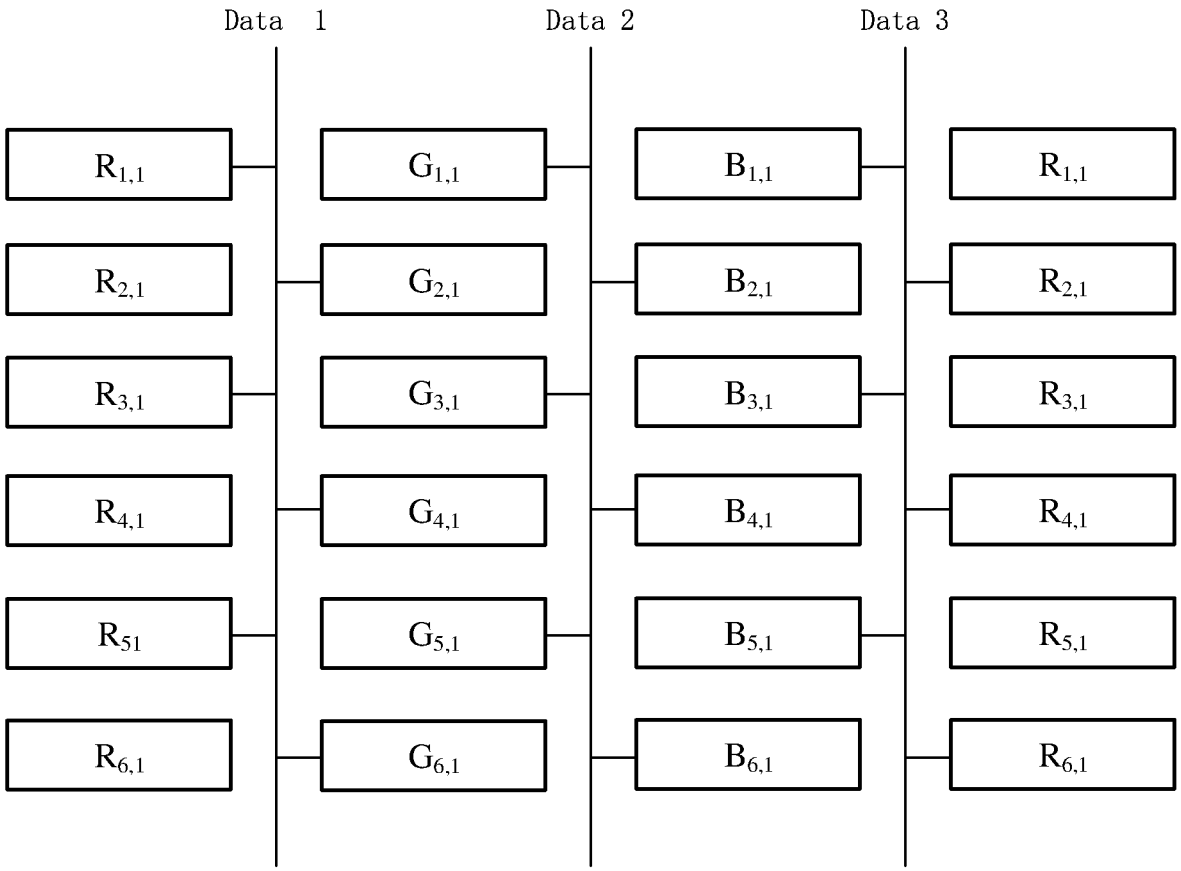
FIG. 3 is a schematic diagram of a pixel structure applied by a pixel compensation method in some embodiments of the present disclosure.
FIG. 4 is a schematic structural diagram of a second compensation value stored in a LUT applied by a pixel compensation method in some embodiments of the present disclosure.

For example, as shown in FIG. 3, it is assumed that sub-pixels in a row direction of the display area in some embodiments of the present disclosure are arranged cyclically in an order of red sub-pixel R, green sub-pixel G and blue sub-pixel B; the data line includes Data 1, Data 2 and Data 3. A column of sub-pixels is arranged between two adjacent columns of data lines; the sub-pixel of the column of sub-pixels which is in an odd-numbered row is configured to load a data signal of the data line on one side, and the sub-pixel of the column of sub-pixels which is in an even-numbered row is configured to load a data signal of the data line on the other side;

acquiring the first compensation value $P_{(i,j)}$ according to formula 1: $P_{(i,j)}=K_3[(K_1R'_{(i-2,j)}+K_2B'_{(i-1,j-1)})-R_{(i,j)}]+R_{(i,j)}$, in the case that the target sub-pixel is a red target sub-pixel;

acquiring the first compensation value $P_{(i,j)}$ according to formula 2: $P_{(i,j)}=K_3[(K_1G'_{(i-2,j)}+K_2B'_{(i-1,j)})-G_{(i,j)}]+G_{(i,j)}$, in the case that the target sub-pixel is a green target sub-pixel;

acquiring the first compensation value $P_{(i,j)}$ according to formula 2: $P_{(i,j)}=K_3[(K_1B'_{(i-2,j)}+K_2G'_{(i-1,j)})-B_{(i,j)}]+B_{(i,j)}$, in the case that the target sub-pixel is a blue target sub-pixel;

where i represents an $i^{th}$ row of pixels in the display area where the referenced sub-pixels are arranged in, and j represents a $j^{th}$ column of pixels in the display area where the referenced sub-pixels are arranged in;

in formula 1, $R_{(i,j)}$ represents the display parameter of the red target sub-pixel before being compensated; $R'_{(i-2,j)}$ represents the display parameter of the red reference sub-pixel after being charged; $B'_{(i-1,j-1)}$ represents the display parameter of the blue reference sub-pixel after being charged;

in formula 2, $G_{(i,j)}$ represents the display parameter of the green target sub-pixel before being compensated; $G'_{(i-2,j)}$ represents the display parameter of the green reference sub-pixel after being charged; $B'_{(i-1,j)}$ represents the display parameter of the blue reference sub-pixel after being charged;

in formula 3, $B_{(i,j)}$ represents the display parameter of the blue target sub-pixel before being compensated; $B'_{(i-2,j)}$ represents the display parameter of the blue reference sub-pixel after being charged; $G'_{(i-1,j)}$ represents the display parameter of the green reference sub-pixel after being charged.

For example, there are three data lines in FIG. 2, namely Data 1, Data 2 and Data 3. Assuming that the target sub-pixel is the blue sub-pixel $B_{(4,1)}$ in the fourth row and first column, the corresponding data line in FIG. 2 is Data 2, and the reference sub-pixel is the blue sub-pixel $B_{(2,1)}$ and green sub-pixel $G_{(3,1)}$ charged by Data 2.

$K_1B'_{(2,1)}+K_2G'_{(3,1)}$ is the weighted sum value of display parameter of the reference sub-pixels $B_{(2,1)}$ and $G_{(3,1)}$. If $K_1$ is 0.5, it means that the average of the display parameters of the reference sub-pixels $B_{(2,1)}$ and $G_{(3,1)}$ is taken.

After the first compensation value is determined by the above calculation method, the display parameter of the target sub-pixel can be compensated according to the first compensation value.

In addition, in the display device, the sub-pixel needs load two kinds of signals, namely, the data signal on the data line and the scan signal on the gate line. Among them, the data signal comes from the source driver, and the scan signal comes from the gate driver. The farther the sub-pixel is from the source driver and/or the gate driver, the greater the driving attenuation of the data signal and/or scan signal will be. In order to eliminate the driving difference caused by the driving distance between the sub-pixels, some embodiments of the present disclosure may further perform compensation of the display parameters of the target sub-pixel according to the second compensation value when step 14 is performed.

That is, some embodiments of the present disclosure before performing the above step 12, further acquire a second compensation value of the target sub-pixel from a display lookup table;

where the display lookup table stores second compensation values of all sub-pixels in the display area; a magnitude of the second compensation value of each sub-pixel has a corresponding relationship with a position of the sub-pixel relative to a source driver and/or with a position of the sub-pixel relative to a gate driver.

In practical applications, the above-mentioned second compensation value can be stored as a priori knowledge in the LUT. For example, the LUT storage structure is shown in FIG. 4, in FIG. 4, $LUT_{(m,n)}$ represents the second compensation value of the sub-pixel stored in the LUT, m and n are the number of row and column corresponding to the sub-pixel in the display area respectively.

For example, when determining the second compensation value of the target sub-pixel $B_{(4,1)}$, some embodiments of the present disclosure may directly retrieve the value of $LUT_{(4,1)}$ from the LUT.

It can be seen from FIG. 4 that the storage structure of the second compensation value in some embodiments of the present disclosure corresponds to the position of its corresponding sub-pixel, so the search is convenient and quick, and can quickly respond to the compensation demand.

In specific implementation, the second compensation value may be a change value of the display parameter, that is, the display parameter of the compensated target sub-pixel finally determined by some embodiments of the present disclosure is the sum of the first compensation value and the second compensation value.

For example, if the target sub-pixel is the blue sub-pixel in the fourth row and first column, the display parameters after compensation is: $P_{(4,1)}=K_3[(K_1B'_{(2,1)}+K_2G'_{(3,1)})-B_{(4,1)}]+B_{(4,1)}$.

It should be noted that the present disclosure is not limited to the specific form of the display parameters, but any parameter that affects the display effect may adopt the compensation scheme in some embodiments of the present disclosure. For example, the display parameter may be the driving current, driving voltage, or gray-scale value of the sub-pixel.

Taking the gray-scale value as an example, in the process of compensating the gray-scale value of the target subpixel based on the compensation value, if the theoretically compensated gray-scale value of the target subpixel exceeds the maximum gray-scale value supported by the target subpixel, the maximum gray-scale value is taken as the gray-scale value after the target sub-pixel is actually compensated.

Taking the compensation of the gray-scale value as an example, the flow in some embodiments of the present disclosure will be described below.

Figure 5:
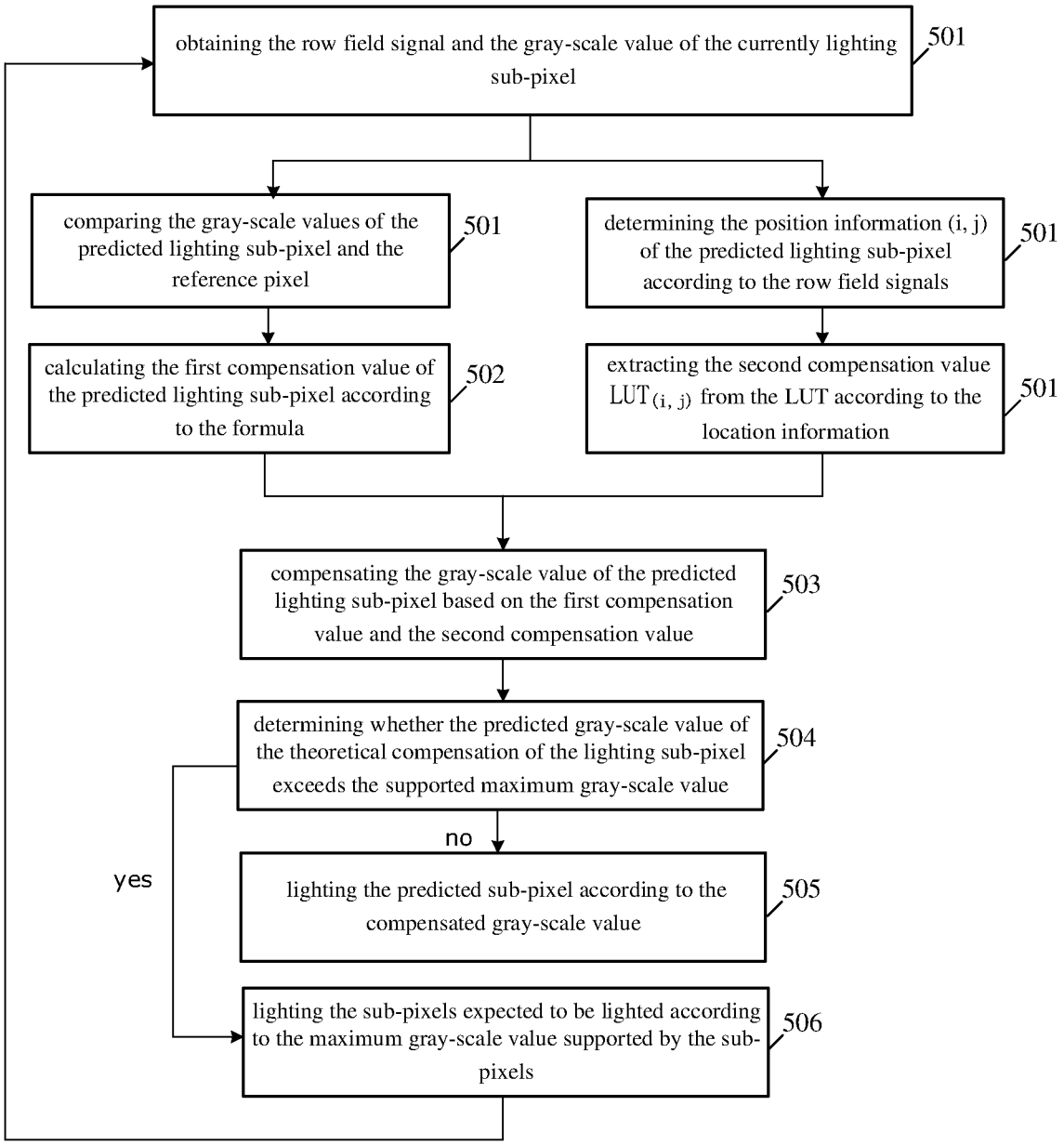
FIG. 5 is a schematic flowchart of a pixel compensation method in some embodiments of the present disclosure in actual application.

As shown in FIG. 5, the pixel compensation method in some embodiments of the present disclosure includes:

step 501: obtaining the row field signal and the gray-scale value of the currently lighting sub-pixel; after that, performing step 501 and step 501*, respectively.

step 501: determining the position information (i,j) of the predicted lighting sub-pixel according to the row field signals; then executing step 502.

step 502: extracting the second compensation value $LUT_{(i,j)}$ from the LUT according to the location information.

step 501, comparing the gray-scale values of the predicted lighting sub-pixel and the reference pixel.

step 502, calculating the first compensation value of the predicted lighting sub-pixel according to the formula.

executing step 503, after step 502 and step 502.

step 503: compensating the gray-scale value of the predicted lighting sub-pixel based on the first compensation value and the second compensation value.

step 504, determining whether the predicted gray-scale value of the theoretical compensation of the lighting sub-pixel exceeds the supported maximum gray-scale value; otherwise, executing step 505; if yes, executing step 506.

step 505, lighting the predicted sub-pixel according to the compensated gray-scale value.

step 506, lighting the sub-pixels expected to be lighted according to the maximum gray-scale value supported by the sub-pixels.

Figure 6:
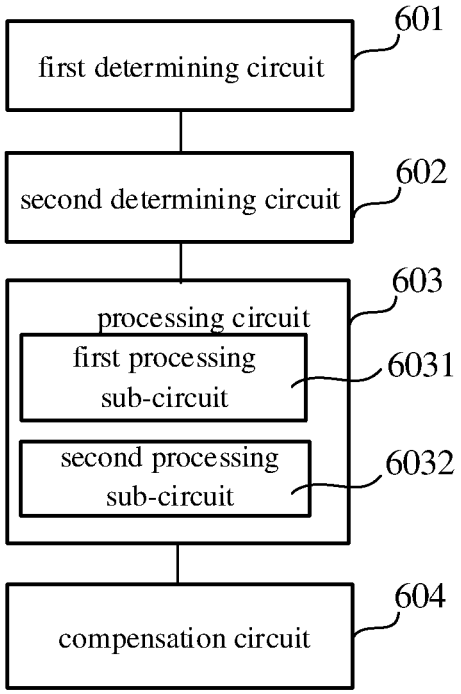
FIG. 6 is a schematic diagram of a logical structure of a pixel compensation device in some embodiments of the present disclosure.

On the other hand, a pixel compensation device is further provided in some embodiments of the present disclosure, as shown in FIG. 6, including:

a first determining circuit 601, configured to determine a target sub-pixel to be compensated in a display area;

a second determining circuit 602, configured to set at least one charged sub-pixel connected to a same data line as the target sub-pixel as a reference sub-pixel;

a processing circuit 603, configured to acquire a compensation value of the target sub-pixel; the processing circuit further includes a first processing sub-circuit 6031, configured to acquire a first compensation value according to the display parameter of the target sub-pixel and a display parameter of the reference sub-pixel;

a compensation circuit 604, configured to compensating a display parameter of the target sub-pixel based on the compensation value (including the above first compensation value).

Obviously, the pixel compensation devices in some embodiments of the present disclosure are the main body of execution of the pixel compensation method provided by the present disclosure. The technical effects that can be achieved by the pixel compensation method can also be achieved by the pixel compensation devices in some embodiments of the present disclosure.

Specifically, the above determining circuit 601 in some embodiments of the present disclosure may determine the target sub-pixel to be compensated in the display area according to the row field signals driving the display area.

Specifically, the first processing sub-circuit 6021 in some embodiments of the present disclosure is further configured to: subtract the weighted sum value of the display parameters of all reference sub-pixels and the display parameters of the target sub-pixel, and the difference value obtained by subtraction is quantized to obtain the first compensation value.

For example, there are two reference sub-pixels; the first processing sub-circuit can acquire the first compensation value $P_{(i,j)}$ according to a formula $P_{(i,j)}=K_3[(K_1p_1+K_2p_2)-p]+p$;

where p represents a display parameter of the target sub-pixel before being compensated; $p_1$ represents a display parameter of one reference sub-pixel after being charged, $p_2$ represents a display parameter of another reference sub-pixel after being charged; $K_1$ is a first coefficient, $K_2$ is a second coefficient, $K_3$ is a third coefficient.

In practical applications, the values of $K_1$ and $K_2$ have a corresponding relationship with the display parameters of the reference sub-pixel, and the values of $K_3$ have a corresponding relationship with the display parameters of the reference sub-pixel and the display parameters before the target sub-pixel is compensated.

For example, as shown in FIG. 3, it is assumed that sub-pixels in a row direction of the display area in some embodiments of the present disclosure are arranged cyclically in an order of red sub-pixel, green sub-pixel and blue sub-pixel. A column of sub-pixels is arranged between two adjacent columns of data lines; the sub-pixel of the column of sub-pixels which is in an odd-numbered row is configured to load a data signal of the data line on one side, and the sub-pixel of the column of sub-pixels which is in an even-numbered row is configured to load a data signal of the data line on the other side;

the first processing sub-circuit is further configured to:

acquire the first compensation value$P_{(i,j)}$ according to formula 1: $P_{(i,j)}=K_3[(K_1R'_{(i-2,j)}+K_2B'_{(i-1,j-1)})-R_{(i,j)}]+R_{(i,j)}$, in the case that the target sub-pixel is a red target sub-pixel;

acquire the first compensation value$P_{(i,j)}$ according to formula 2: $P_{(i,j)}=K_3[(K_1G'_{(i-2,j)}+K_2B'_{(i-1,j)})-G_{(i,j)}]+G_{(i,j)}$, in the case that the target sub-pixel is a green target sub-pixel;

acquire the first compensation value$P_{(i,j)}$ according to formula 2: $P_{(i,j)}=K_3[(K_1B'_{(i-2,j)}+K_2\ G'_{(i-1,j)})-B_{(i,j)}]+B_{(i,j)}$, in the case that the target sub-pixel is a blue target sub-pixel;

where i represents an $i^{th}$ row of pixels in the display area where the referenced sub-pixels are arranged in, and j represents a $j^{th}$ column of pixels in the display area where the referenced sub-pixels are arranged in; $R_{(i,j)}$ represents the display parameter of the red target sub-pixel before being compensated; $R'_{(i-2,j)}$ represents the display parameter of the red reference sub-pixel after being charged; $B'_{(i-1,j-1)}$ represents the display parameter of the blue reference sub-pixel after being charged; $G_{(i,j)}$ represents the display parameter of the green target sub-pixel before being compensated; $G'_{(i-2,j)}$ represents the display parameter of the green reference sub-pixel after being charged; $B'_{(i-1,j)}$ represents the display parameter of the blue reference sub-pixel after being charged; $B_{(i,j)}$ represents the display parameter of the blue target sub-pixel before being compensated; $B'_{(i-2,j)}$ represents the display parameter of the blue reference sub-pixel after being charged; $G'_{(i-1,j)}$ represents the display parameter of the green reference sub-pixel after being charged.

In addition, referring to FIG. 6, on the basis of the above, the processing circuit 602 in some embodiments of the present disclosure further includes: a second processing sub-circuit 6032, configured to acquire a second compensation value of the target sub-pixel from a display lookup table;

where the display lookup table stores second compensation values of all target sub-pixels in the display area; a magnitude of a second compensation value of each target sub-pixel has a corresponding relationship with a position of the target sub-pixel relative to the source driver and/or with a position of the target sub-pixel relative to the gate driver.

In addition, some embodiments of the present disclosure also provide a display device including the pixel compensation device provided by the present disclosure.

In practical applications, the display device in some embodiments of the present disclosure may be a display product such as a mobile phone, a tablet, or a TV. Based on the pixel compensation device of the present disclosure, the display device in some embodiments of the present disclosure can effectively resolve the occurrence of Mura in the display screen Problems, thereby improving the user's viewing experience, and therefore has high practical value.

Figure 7:
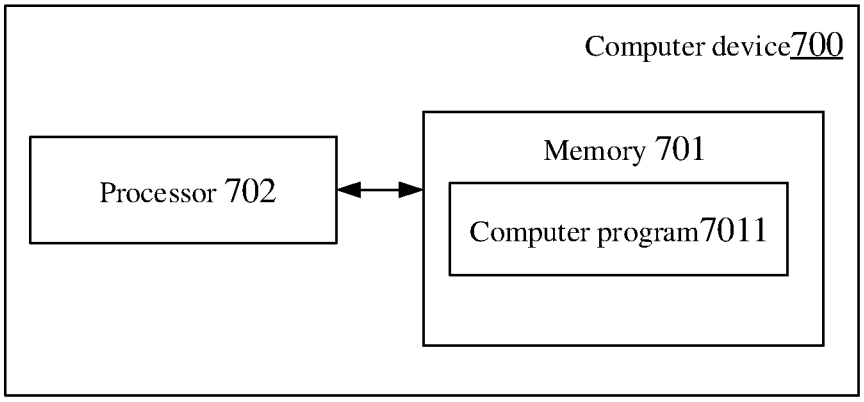
FIG. 7 is a schematic diagram of the actual structure of a computer device in some embodiments of the present disclosure.

In addition, as shown in FIG. 7, a computer device 700 is further provided in some embodiments of the present disclosure, including: a memory 701, a processor 702, and a computer program 7011 stored in the memory 701 and executable on the processor 702, where the computer program 7011 is executed by the processor to:

determine a target sub-pixel to be compensated in a display area;

set at least one charged sub-pixel connected to a same data line as the target sub-pixel as a reference sub-pixel;

acquire a compensation value of the target sub-pixel; and compensate a display parameter of the target sub-pixel based on the compensation value.

In some embodiments of the present disclosure, the computer program 7011 is executed by the processor to:

acquire a first compensation value according to the display parameter of the target sub-pixel and a display parameter of the reference sub-pixel.

where the processor 702 in some embodiments of the present disclosure executes the computer program 7011 to determine the target sub-pixel to be compensated in the display area, the steps of which include:

determining the target sub-pixel to be compensated in the display area according to the row field signals driving the display area.

where the reference sub-pixel is a sub-pixel that is charged in a pre-charging stage of the target sub-pixel.

Specifically, there are two reference sub-pixels.

The processor 702 in some embodiments of the present disclosure executes the above-mentioned computer program 7011 to compare the display parameter of the target sub-pixel with the display parameter of the reference sub-pixel, and obtain the first compensation value, the steps of which include:

acquiring the first compensation value $P_{(i,j)}$ according to the formula: $P_{(i,j)}=K_3[(K_1p_1+K_2p_2)-p]+p$;

where p represents a display parameter of the target sub-pixel before being compensated; $p_1$ represents a display parameter of one reference sub-pixel after being charged, $p_2$ represents a display parameter of another reference sub-pixel after being charged; $K_1$ is a first coefficient, $K_2$ is a second coefficient, $K_3$ is a third coefficient.

In practical applications, the values of $K_1$ and $K_2$ have a corresponding relationship with the display parameters of the reference sub-pixel, and the values of $K_3$ have a corresponding relationship with the display parameters of the reference sub-pixel and the display parameters before the target sub-pixel is compensated.

For example, sub-pixels in a row direction of the display area in some embodiments of the present disclosure are arranged cyclically in an order of red sub-pixel, green sub-pixel and blue sub-pixel. A column of sub-pixels is arranged between two adjacent columns of data lines; the sub-pixel of the column of sub-pixels which is in an odd-numbered row is configured to load a data signal of the data line on one side, and the sub-pixel of the column of sub-pixels which is in an even-numbered row is configured to load a data signal of the data line on the other side;

the steps of acquiring the first compensation value specifically include:

acquiring the first compensation value $P_{(i,j)}$ according to formula 1: $P_{(i,j)}=K_3[(K_1R'_{(i-2,j)}+K_2B'_{(i-1,j-1)})-R_{(i,j)}]+R_{(i,j)}$, in the case that the target sub-pixel is a red target sub-pixel;

acquiring the first compensation value $P_{(i,j)}$ according to formula 2: $P_{(i,j)}=K_3[(K_1G'_{(i-2,j)}+K_2B'_{(i-1,j)})-G_{(i,j)}]+G_{(i,j)}$, in the case that the target sub-pixel is a green target sub-pixel;

acquiring the first compensation value $P_{(i,j)}$ according to formula 2: $P_{(i,j)}=K_3[(K_1B'_{(i-2,j)}+K_2G'_{(i-1,j)})-B_{(i,j)}]+B_{(i,j)}$, in the case that the target sub-pixel is a blue target sub-pixel;

where i represents an $i^{th}$ row of pixels in the display area where the referenced sub-pixels are arranged in, and j represents a $j^{th}$ column of pixels in the display area where the referenced sub-pixels are arranged in; $R_{(i,j)}$ represents the display parameter of the red target sub-pixel before being compensated; $R'_{(i-2,j)}$ represents the display parameter of the red reference sub-pixel after being charged; $B'_{(i-1,j-1)}$ represents the display parameter of the blue reference sub-pixel after being charged; $G_{(i,j)}$ represents the display parameter of the green target sub-pixel before being compensated; $G'_{(i-2,j)}$ represents the display parameter of the green reference sub-pixel after being charged; $B'_{(i-1,j)}$ represents the display parameter of the blue reference sub-pixel after being charged; $B_{(i,j)}$ represents the display parameter of the blue target sub-pixel before being compensated; $B'_{(i-2,j)}$ represents the display parameter of the blue reference sub-pixel after being charged; $G'_{(i-1,j)}$ represents the display parameter of the green reference sub-pixel after being charged.

the step of the processor 702 in some embodiments of the present disclosure executing the above computer program 7011 to obtain the compensation value of the target sub-pixel further includes:

acquiring a second compensation value of the target sub-pixel from a display lookup table;

where the display lookup table stores second compensation values of all target sub-pixels in the display area; a magnitude of a second compensation value of each target sub-pixel has a corresponding relationship with a position of the target sub-pixel relative to the source driver and/or with a position of the target sub-pixel relative to the gate driver.

The display parameter is a gray-scale value. In some embodiments of the present disclosure, the processor 702 executes the computer program 7011 to compensate the gray-scale value of the target sub-pixel with the base compensation value, in the process of which, if the theoretically compensated gray-scale value of the target subpixel exceeds the maximum gray-scale value supported by the target subpixel, the maximum gray-scale value is taken as the gray-scale value after the target sub-pixel is actually compensated.

It can be understood that the memory 701 in this embodiment may be a volatile memory or a nonvolatile memory, or may include both volatile and nonvolatile memory.

The computer readable medium including a persistent medium and a non-persistent medium, a movable medium and a non-movable medium, may store information through any method or technology. The information may be computer-readable instructions, data structures, modules of programs or other data. Examples of the computer storage medium include, but are not limited to, a Phase-change Random Access Memory (PRAM), a Static Random Access Memory (SRAM), a Dynamic Random Access Memory (DRAM), other types of Random Access Memory (RAM), a Read-Only Memory (ROM), an Electrically Erasable Programmable Read-Only Memory (EEPROM), a flash memory or other memory technologies, a Compact Disc Read-Only Memory (CD-ROM), a Digital Versatile Disc (DVD) or other optical storage, a cassette tape, a tape magnetic disk storage or other magnetic storage device or any other non-transmission medium. The computer storage medium may store information that may be accessed by a computing device. According to a definition in the present disclosure, the computer readable medium does not include a transitory medium, such as a modulated data signal and a carrier.

In addition, a computer readable storage medium storing a computer program is further provided in some embodiments of the present disclosure, where the computer program is executed by a processor to:

determine a target sub-pixel to be compensated in a display area;

set at least one charged sub-pixel connected to a same data line as the target sub-pixel as a reference sub-pixel;

acquire a compensation value of the target sub-pixel;

compensate a display parameter of the target sub-pixel based on the compensation value.

In some embodiments of the present disclosure, when the program is executed by the processor, the following steps are also implemented: acquiring a first compensation value according to the display parameter of the target sub-pixel and a display parameter of the reference sub-pixel.

where the reference sub-pixel is a sub-pixel that is charged in a pre-charging stage of the target sub-pixel.

For example, there are two reference sub-pixels.

The computer program in some embodiments of the present disclosure is executed by the processor to determine the target sub-pixel to be compensated in the display area, including: acquiring the first compensation value $P_{(i,j)}$ according to a formula $P_{(i,j)}=K_3[(K_1p_1+K_2p_2)-p]+p$;

where p represents a display parameter of the target sub-pixel before being compensated; $p_1$ represents a display parameter of one reference sub-pixel after being charged, $p_2$ represents a display parameter of another reference sub-pixel after being charged; $K_1$ is a first coefficient, $K_2$ is a second coefficient, $K_3$ is a third coefficient.

In practical applications, the values of $K_1$ and $K_2$ have a corresponding relationship with the display parameters of the reference sub-pixel, and the values of $K_3$ have a corresponding relationship with the display parameters of the reference sub-pixel and the display parameters before the target sub-pixel is compensated.

For example, sub-pixels in a row direction of the display area in some embodiments of the present disclosure are arranged cyclically in an order of red sub-pixel, green sub-pixel and blue sub-pixel. A column of sub-pixels is arranged between two adjacent columns of data lines; the sub-pixel of the column of sub-pixels which is in an odd-numbered row is configured to load a data signal of the data line on one side, and the sub-pixel of the column of sub-pixels which is in an even-numbered row is configured to load a data signal of the data line on the other side;

the steps of acquiring the first compensation value specifically include:

acquiring the first compensation value $P_{(i,j)}$ according to formula 1: $P_{(i,j)}=K_3[(K_1R'_{(i-2,j)}+K_2B'_{(i-1,j-1)})-R_{(i,j)}]+R_{(i,j)}$, in the case that the target sub-pixel is a red target sub-pixel;

acquiring the first compensation value$P_{(i,j)}$ according to formula 2: $P_{(i,j)}=K_3[(K_1G'_{(i-2,j)}+K_2B'_{(i-1,j)})-G_{(i,j)}]+G_{(i,j)}$, in the case that the target sub-pixel is a green target sub-pixel;

acquiring the first compensation value$P_{(i,j)}$ according to formula 2: $P_{(i,j)}=K_3[(K_1B'_{(i-2,j)}+K_2G'_{(i-1,j)})-B_{(i,j)}]+B_{(i,j)}$, in the case that the target sub-pixel is a blue target sub-pixel;

where i represents an $i^{th}$ row of pixels in the display area where the referenced sub-pixels are arranged in, and j represents a $j^{th}$ column of pixels in the display area where the referenced sub-pixels are arranged in; $R_{(i,j)}$ represents the display parameter of the red target sub-pixel before being compensated; $R'_{(i-2,j)}$ represents the display parameter of the red reference sub-pixel after being charged; $B'_{(i-1,j-1)}$ represents the display parameter of the blue reference sub-pixel after being charged; $G_{(i,j)}$ represents the display parameter of the green target sub-pixel before being compensated; $G'_{(i-2,j)}$ represents the display parameter of the green reference sub-pixel after being charged; $B'_{(i-1,j)}$ represents the display parameter of the blue reference sub-pixel after being charged; $B_{(i,j)}$ represents the display parameter of the blue target sub-pixel before being compensated; $B'_{(i-2,j)}$ represents the display parameter of the blue reference sub-pixel after being charged; $G'_{(i-1,j)}$ represents the display parameter of the green reference sub-pixel after being charged.

In addition, the step of obtaining the compensation value of the target sub-pixel when the calculation program in some embodiments of the present disclosure is executed by the processor further includes:

acquiring a second compensation value of the target sub-pixel from a display lookup table;

where the display lookup table stores second compensation values of all target sub-pixels in the display area; a magnitude of a second compensation value of each target sub-pixel has a corresponding relationship with a position of the target sub-pixel relative to the source driver and/or with a position of the target sub-pixel relative to the gate driver.

In addition, for example, the display parameters in some embodiments of the present disclosure may be gray-scale values.

In some embodiments of the present disclosure, the computer program is executed by the processor to compensate the gray-scale value of the target sub-pixel based on the compensation value, in the process of which, if the theoretically compensated gray-scale value of the target subpixel exceeds the maximum gray-scale value supported by the target subpixel, the maximum gray-scale value is taken as the gray-scale value after the target sub-pixel is actually compensated.

The embodiments of the present disclosure are described with reference to flowcharts and/or block diagrams of the method, the device (system) and the computer program product in the embodiments of the present disclosure. It should be appreciated that each process in the flowcharts and/or each block in the block diagrams, and a combination of a process in the flowcharts and/or a block in the block diagrams may be implemented by computer program instructions. The computer program instructions may be provided to a processor of a general purpose computer, a special purpose computer, an embedded processor, or other programmable data processing device to produce a machine, such that the instructions executed by the processor of the computer or other programmable data processing device produces a device of realizing functions specified in one or more processes in the flowcharts and/or one or more blocks in the block diagrams.

The computer program instructions may also be stored in a computer-readable memory capable of directing a computer or other programmable data processing device to operate in a particular manner, such that the instructions stored in the computer-readable memory produce a manufacture including an instruction device, the instruction device implements functions specified in one or more processes in the flowcharts and/or one or more blocks in the block diagrams.

The computer program instructions may also be loaded onto the computer or other programmable data processing device, so that a series of operating steps may be performed on the computer or other programmable device to produce computer-implemented processing, and thus the instructions executed by the computer or other programmable device provide steps for implementing the functions specified in one or more processes in the flowcharts and/or one or more blocks in the block diagrams.

Although some embodiments of some embodiments of the present disclosure have been described, those skilled in the art can make additional changes and modifications to these embodiments once they learn the basic inventive concept. Therefore, the claims are intended to be interpreted as including the embodiments and all changes and modifications falling within the scope of some embodiments of the present disclosure.

It should also be noted that in the present disclosure, relational terms such as first and second are used only to distinguish one entity or operation from another entity or operation, and do not necessarily require or imply there is any such actual relationship or order for these entities or operations. Moreover, the terms "include", "including" or any other variant thereof are intended to cover non-exclusive inclusion, so that a process, method, article or terminal device that includes a series of elements includes not only those elements, but also those that are not explicitly listed The other elements listed out may also include elements inherent to such processes, methods, articles or terminal equipment. Without more restrictions, the element defined by the sentence "include one . . . " does not exclude that there are other identical elements in the process, method, article, or terminal device that includes the element.

The above descriptions are some embodiments of the present disclosure. It should be noted that, modifications and improvements may be made by a person of ordinary skill in the art without departing from the principle of the present disclosure, and these modifications and improvements shall fall within the scope of the present disclosure.

The invention claimed is:

1. A pixel compensation method, comprising:

determining a target sub-pixel to be compensated in a display area;

setting at least one charged sub-pixel connected to a same data line as the target sub-pixel, as a reference sub-pixel;

acquiring a gray-scale compensation value of the target sub-pixel; and compensating a gray-scale value of the target sub-pixel based on the gray-scale compensation values;

wherein the acquiring the gray-scale compensation value of the target sub-pixel comprises: acquiring a first gray-scale compensation value according to the gray-scale value of the target sub-pixel and a gray-scale value of the reference sub-pixel;

wherein the compensating the gray-scale value of the target sub-pixel based on the gray-scale compensation value comprises: compensating the gray-scale value of the target sub-pixel based on the first gray-scale compensation value;

wherein the setting at least one charged sub-pixel connected to a same data line as the target sub-pixel, as the reference sub-pixel comprises: setting two charged sub-pixels connected to the same data line as the target sub-pixel as the reference sub-pixel; and wherein the acquiring the first gray-scale compensation value according to the gray-scale value of the target sub-pixel and the gray-scale value of the reference sub-pixel comprises:

acquiring the first gray-scale compensation value $P_{(i,j)}$ according to a formula $P_{(i,j)}=K_3[(K_1p_1+K_2p_2)-p]+p$;

wherein p represents a gray-scale value of the target sub-pixel before being compensated; $p_1$ represents a gray-scale value of one reference sub-pixel after being charged, $p_2$ represents a gray-scale value of another reference sub-pixel after being charged; $K_1$ is a first coefficient, $K_2$ is a second coefficient, $K_3$ is a third coefficient, wherein p, $p_1$, $p_2$, $K_1$, $K_2$, $K_3$ are greater than 0, and i and j are positive integers greater than 1.

2. The pixel compensation method according to claim 1, wherein the reference sub-pixel is a sub-pixel that is charged in a pre-charging stage of the target sub-pixel.

3. The pixel compensation method according to claim 1, wherein sub-pixels in a row direction of the display area are arranged cyclically in an order of red sub-pixel, green sub-pixel and blue sub-pixel; a column of sub-pixels is arranged between two adjacent columns of data lines;

the sub-pixel of the column of sub-pixels which is in an odd-numbered row is configured to load a data signal of the data line on one side, and the sub-pixel of the column of sub-pixels which is in an even-numbered row is configured to load a data signal of the data line on the other side;

the acquiring the first gray-scale compensation value further comprises:

acquiring the first gray-scale compensation value $P_{(i,j)}$ according to formula 1: $P_{(i,j)}=K_3[(K_1R'_{(i-2,j)}+K_2B'_{(i-1,j-1)})-R_{(i,j)}]+R_{(i,j)}$, in the case that the target sub-pixel is a red target sub-pixel;

acquiring the first gray-scale compensation value $P_{(i,j)}$ according to formula 2: $P_{(i,j)}=K_3[(K_1G'_{(i-2,j)}+K_2B'_{(i-1,j)})-G_{(i,j)}]+G_{(i,j)}$, in the case that the target sub-pixel is a green target sub-pixel;

acquiring the first gray-scale compensation value $P_{(i,j)}$ according to formula 2: $P_{(i,j)}=K_3[(K_1B'_{(i-2,j)}+K_2G'_{(i-1,j)})-B_{(i,j)}]+B_{(i,j)}$, in the case that the target sub-pixel is a blue target sub-pixel;

wherein i represents an $i^{th}$ row of pixels in the display area where the referenced sub-pixels are arranged in, and j represents a $j^{th}$column of pixels in the display area where the referenced sub-pixels are arranged in; $R_{(i,j)}$ represents the gray-scale value of the red target sub-pixel before being compensated; $R'_{(i-2,j)}$ represents the gray-scale value of the red reference sub-pixel after being charged; $B'_{(i-1,j-1)}$ represents the gray-scale value of the blue reference sub-pixel after being charged; $G_{(i,j)}$ represents the gray-scale value of the green target sub-pixel before being compensated; $G'_{(1-2,j)}$ represents the gray-scale value of the green reference sub-pixel after being charged; $B'_{(i-1,j)}$ represents the gray-scale value of the blue reference sub-pixel after being charged; $B_{(i,j)}$ represents the gray-scale value of the blue target sub-pixel before being compensated; $B'_{(i-2,j)}$ represents the gray-scale value of the blue reference sub-pixel after being charged; $G'_{(i-1,j)}$ represents the gray-scale value of the green reference sub-pixel after being charged.

4. The pixel compensation method according to claim 1, wherein prior to the setting at least one charged sub-pixel connected to the same data line as the target sub-pixel as the reference sub-pixel, wherein the method further comprises:

acquiring a second gray-scale compensation value of the target sub-pixel from a display lookup table;

wherein the display lookup table stores second gray-scale compensation values of all sub-pixels in the display area; a magnitude of the second gray-scale compensation value of each sub-pixel has a corresponding relationship with a position of the sub-pixel relative to a source driver and/or with a position of the sub-pixel relative to a gate driver.

5. The pixel compensation method according to claim 4, wherein the compensating gray-scale value of the target sub-pixel based on the gray-scale compensation value comprises:

compensating the gray-scale value of the target sub-pixel based on the first gray-scale compensation value and the second gray-scale compensation value.

6. The pixel compensation method according to claim 4, wherein when compensating the gray-scale value of the target sub-pixel based on the gray-scale compensation value, in the case that a theoretically compensated gray-scale value of the target sub-pixel exceeds a maximum gray-scale value supported by the target sub-pixel, the maximum gray-scale value is used as a gray-scale value of the target subpixel after being actually compensated.

7. A pixel compensation device, comprising:

a first determining circuit, configured to determine a target sub-pixel to be compensated in a display area;

a second determining circuit, configured to set at least one charged sub-pixel connected to a same data line as the target sub-pixel as a reference sub-pixel;

a processing circuit, configured to acquire a gray-scale compensation value of the target sub-pixel; and a compensation circuit, configured to compensate a gray-scale value of the target sub-pixel based on the gray-scale compensation value;

wherein the processing circuit further comprises a first processing sub-circuit, the first processing sub-circuit is configured to acquire a first gray-scale compensation value according to the gray-scale value of the target sub-pixel and a gray-scale value of the reference sub-pixel;

wherein the compensation circuit is further configured to compensate the gray-scale value of the target sub-pixel based on the first gray-scale compensation value; and wherein the first processing sub-circuit is further configured to acquire the first gray-scale compensation value according to the gray-scale value of the target sub-pixel and the gray-scale value of the reference sub-pixel comprises:

the first processing sub-circuit is further configured to acquire the first gray-scale compensation value $P_{(i,j)}$ according to a formula $P_{(i,j)}=K_3[(K_1\ p_1+K_2P_2)-p]+P$;

wherein p represents a gray-scale value of the target sub-pixel before being compensated; $p_1$ represents a gray-scale value of one reference sub-pixel after being charged, $p_2$ represents a gray-scale value of another reference sub-pixel after being charged; $K_1$ is a first coefficient, $K_2$ is a second coefficient, $k_3$ is a third coefficient, wherein p, $p_1$, $p_2$, $K_1$, $K_2$, $K_3$ are greater than 0, and i and j are positive integers greater than 1.

8. The pixel compensation device according to claim 7, wherein the reference sub-pixel is a sub-pixel that is charged in a pre-charging stage of the target sub-pixel.

9. The pixel compensation device according to claim 7, wherein sub-pixels in the row direction of the display area are arranged cyclically in an order of red sub-pixel, green sub-pixel, and blue sub-pixel; a column of sub-pixels is arranged between two adjacent columns of data lines;

the sub-pixel of the column of sub-pixels which is in an odd-numbered row is configured to load a data signal of the data line on one side, and a sub-pixel of the column of sub-pixels which is in an even-numbered row is configured to load a data signal of the data line on the other side;

the first processing sub-circuit is further configured to:

acquiring the first gray-scale compensation value $P_{(i,j)}$ according to formula 1: $P_{(i,j)}=K_3[(K_1R'_{(i-2,j)}+K_2B'_{(i-1,j-1)})-R_{(i,j)}]+R_{(i,j)}$, in the case that the target sub-pixel is a red target sub-pixel;

acquiring the first grey-scale compensation value $P_{(i,j)}$ according to formula 2: $P_{(i,j)}=K_3[(K_1G'_{(i-2,j)}+K_2B'_{(i-1,j)})-G_{(i,j)}]+G_{(i,j)}$, in the case that the target sub-pixel is a green target sub-pixel;

acquiring the first grey-scale compensation value $P_{(i,j)}$ according to formula 2: $P_{(i,j)}=K_3[(K_1B'_{(i-2,j)}+K_2G'_{(i-1,j)})-B_{(i,j)}]+B_{(i,j)}$, in the case that the target sub-pixel is a blue target sub-pixel;

wherein i represents an $i^{th}$ row of pixels in the display area where the referenced sub-pixels are arranged in, and j represents a $j^{th}$ column of pixels in the display area where the referenced sub-pixels are arranged in; $R_{(i,j)}$ represents the gray-scale value of the red target sub-pixel before being compensated; $R'_{(i-2,j)}$ represents the gray-scale value of the red reference sub-pixel after being charged; $B'_{(i-1,j-1)}$ represents the gray-scale value of the blue reference sub-pixel after being charged; $G_{(i,j)}$ represents the gray-scale value of the green target sub-pixel before being compensated; $G'_{(i-2,j)}$ represents the gray-scale value of the green reference sub-pixel after being charged; $B'_{(i-1,j)}$ represents the gray-scale value of the blue reference sub-pixel after being charged; $B_{(i,j)}$ represents the gray-scale value of the blue target sub-pixel before being compensated; $B'_{(i-2,j)}$ represents the gray-scale value of the blue reference sub-pixel after being charged; $G'_{(i-1,j)}$ represents the gray-scale value of the green reference sub-pixel after being charged.

10. The pixel compensation device according to claim 7, wherein the processing circuit further comprises a second processing sub-circuit, configured to acquire a second gray-scale compensation value of the target sub-pixel from a display lookup table;

wherein the display lookup table stores second gray-scale compensation values of all target sub-pixels in the display area; a magnitude of a second gray-scale compensation value of each target sub-pixel has a corresponding relationship with a position of the target sub-pixel relative to a source driver and/or with a position of the target sub-pixel relative to a gate driver.

11. The pixel compensation device according to claim 10, wherein the compensation circuit is further configured to compensate the gray-scale value of the target sub-pixel based on the first gray-scale compensation value and the second gray-scale compensation value.

12. A display device comprising the pixel compensation device according to claim 7.

13. A computer device, comprising:

a processor, a memory and a computer program stored in the memory and executable on the processor, wherein the computer program is executed by the processor to:

determine a target sub-pixel to be compensated in a display area; set at least one charged sub-pixel connected to a same data line as the target sub-pixel as a reference sub-pixel;

acquire a gray-scale compensation value of the target sub-pixel; and compensate a gray-scale value of the target sub-pixel based on the gray-scale compensation value;

wherein the processor further comprises:

a first processing sub-circuit, the first processing sub-circuit is configured to acquire a first gray-scale compensation value according to the gray-scale value of the target sub-pixel and a gray-scale value of the reference sub-pixel;

wherein a compensation circuit of the processor is configured to compensate the gray-scale value of the target sub-pixel based on the first gray-scale compensation value; and wherein the first processing sub-circuit being configured to acquire the first gray-scale compensation value according to the gray-scale value of the target sub-pixel and the gray-scale value of the reference sub-pixel comprises:

the first processing sub-circuit is further configured to acquire a first gray-scale compensation value $P_{(i,j)}$ according to a formula $P_{(i,j)}=K_3\ [(K_1p_1+K_2\ p_2)-p]+p$; wherein p represents a gray-scale value of the target sub-pixel before being compensated; $p_i$ represents a gray-scale value of one reference sub-pixel after being charged; $p_2$ represents a gray-scale value of another reference sub-pixel after being charged; $K_1$ is a first coefficient, $K_2$ is a second coefficient, $K_3$ is a third coefficient, wherein p, $p_1$, $p_2$, $K_1$, $K_2$, $K_3$ are greater than 0, and i and j are positive integers greater than 1.

* * * * *